US005323858A

United States Patent [19]

Jones et al.

[11] Patent Number: 5,323,858

[45] Date of Patent: Jun. 28, 1994

[54] CASE CEMENTING METHOD AND SYSTEM

[75] Inventors: Richard R. Jones; Kenneth R. Taylor, both of Allen, Tex.

[73] Assignee: Atlantic Richfield Company, Los Angeles, Calif.

[21] Appl. No.: 977,951

[22] Filed: Nov. 18, 1992

[51] Int. Cl.[5] ..... E21B 33/16

[52] U.S. Cl. ..... 166/291; 166/153

[58] Field of Search ..... 166/291, 153, 155, 156, 166/192, 242

[56] References Cited

U.S. PATENT DOCUMENTS

| | | | |
|---|---|---|---|
| 2,743,779 | 5/1956 | Brown | 166/291 X |
| 3,183,971 | 5/1965 | McEver et al. | 166/291 X |
| 4,589,495 | 5/1986 | Langer et al. | 166/156 X |
| 4,836,279 | 6/1989 | Freeman | 166/291 X |
| 4,880,058 | 11/1989 | Lindsey et al. | 166/291 X |

*Primary Examiner*—William P. Neuder

*Attorney, Agent, or Firm*—Joseph D. Yao

[57] ABSTRACT

A system for cementing well casing in a bore hole utilizes only top and bottom cementing plugs. The well casing has on its lower end, an inwardly extending lip to engage a latch on the lower portion of the bottom cementing plug. The bottom cementing plug has a through passage that is covered on the top by a diaphragm and on the bottom by another diaphragm.

7 Claims, 1 Drawing Sheet

CASE CEMENTING METHOD AND SYSTEM

BACKGROUND OF THE INVENTION

1. Field of the Invention

This invention relates to an improved method and system for cementing the casing of an oil well in a bore hole.

2. Background

Currently, conventional oil wells require that drilling equipment be used to create a bore hole to a desired depth. The drilling equipment is removed and replaced with a casing string that is secured in the bore hole by cement. Generally, the casing is run down the bore hole with a closed end, typically with a guide shoe and a float collar.

A simple guide shoe, such as an open-end collar with a molded nose, is attached at the end of the casing string. This shoe directs the casing away from ledges in the bore hole and minimizes caving of the sidewalls of the bore hole. At a point one to three joints above the guide shoe is the float collar that prevents fluids from entering the casing string. This closed end allows the casing string to be floated down the bore hole, at the same time increasing pressure on the bore hole walls by the displacement of mud and fluid from the center of the bore hole. This pressure can cause a strain on weaker formations to break down or plant the casing above the desired depth.

If the close-ended casing string has become planted or mud is needed to be cleared from around the casing, the casing string is reciprocated or rotated. This reciprocation may result in a swab-surge effect on the bore hole walls. If the casing string is hung up on an obstruction in the bore hole, the casing is either reciprocated and rotated through the obstruction or the casing is pulled out of the bore hole so that drilling equipment can re-enter to remove the obstruction. It is only after the closed-end casing has reached the desired depth in the bore hole may the cementing process be carried out.

A commonly-used cementing method for close-ended casing requires only a top and bottom cementing plug with a cement slurry interposed. The bottom plug is pressed into the casing to clear mud and debris from the inside of the casing string to prevent contamination of the cement slurry. The top plug forces down the cement slurry against the bottom plug. When the bottom plug reaches the float collar, the pressure from the cement slurry ruptures the upper diaphragm on the top of the bottom plug and passes through the hollow center and down through the lower diaphragm out, into and around the guide shoe and up and around the annular space between the bore hole and casing. The drawback to this case cementing method is the requirement that the casing be close-ended. This close-ended configuration can damage the formation and inhibit the casing string from reaching its desired depth. This cementing method requires additional equipment and may require a protracted rig time to set the well. It is to this end that the present invention has been developed to provide a system and method for cementing casing in a bore hole.

SUMMARY OF THE INVENTION

In accordance with the present invention, a system for cementing a casing in a bore hole is provided without a float collar or float shoe on the casing. The system includes a bottom plug having a hollow, cylindrical body that is press-fit into the inner wall of the casing and a coupling device, engagable with the bottom portion of the casing. The bottom plug has a first and second diaphragm that covers the top and bottom of the body. Only after the cement slurry exceeds a certain pressure does the cement rupture the diaphragms and flows through the bottom plug and out and around into the annular space around the casing.

Preferably a check valve is located within the body of the bottom plug to prevent cement from returning up and through the bottom plug. It is also preferred that the bottom plug have a plurality of external wiper blades to clean the inner wall of the casing.

In accordance with another aspect of the present invention, there is provided a method for cementing the casing in the bore hole wherein a casing having no float collar or float shoe is modified to engage a modified bottom plug that is pumped down by cement slurry that is pushed down by a top plug so that the bottom plug engages with the bottom of the well casing so that the cement slurry can then be forced down through the bottom plug at end of the casing and into the annular space between the casing and the bore hole.

Objects, features and advantages of this invention are to provide a method and system that can facilitate cementing a casing in a bore hole through a simplified and economical design, manufacture and assembly.

BRIEF DESCRIPTION OF THE DRAWING

These and other objects, features and advantages of the invention will be apparent from the following detailed description, appended claims and accompanying drawings in which:

1.

DESCRIPTION OF A PREFERRED EMBODIMENT

Figure 1:
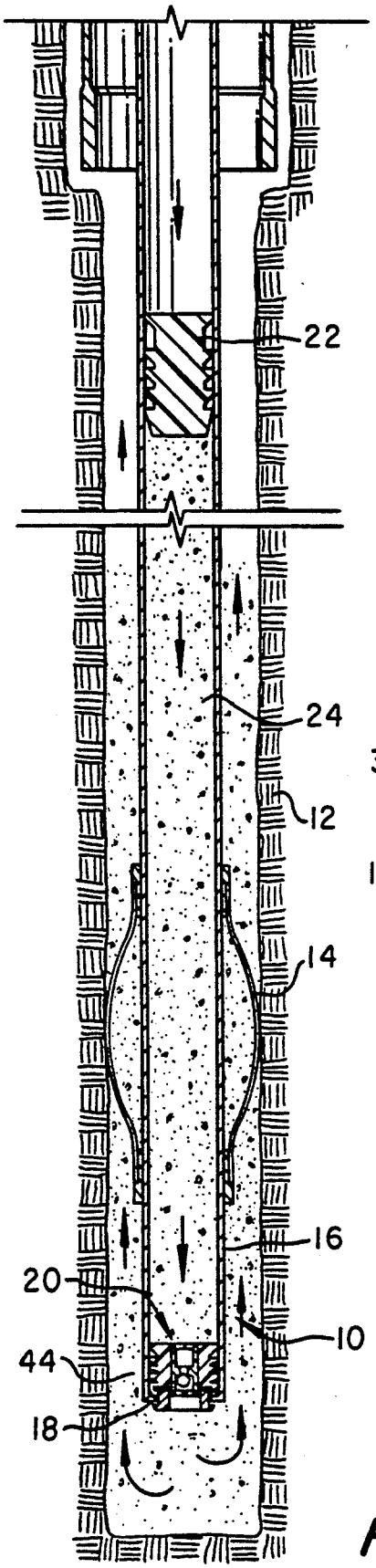
FIG. 1 is a side elevation sectional view of a case cementing system embodying this invention within a bore hole; and 2.

With specific reference to FIG. 1, a case cementing system in accordance with the present invention is designated generally by the reference character 10. The cementing system 10 shown centered in well bore hole 12 by centralizers 14, includes a modified casing section 16 with an inwarding- extending lip 18, a bottom cementing plug 20 and a top cementing plug 22. Interposed between the plugs 20 and 22 is a cement slurry 24, used to anchor the casing 16 in the bore hole 12.

Figure 2:
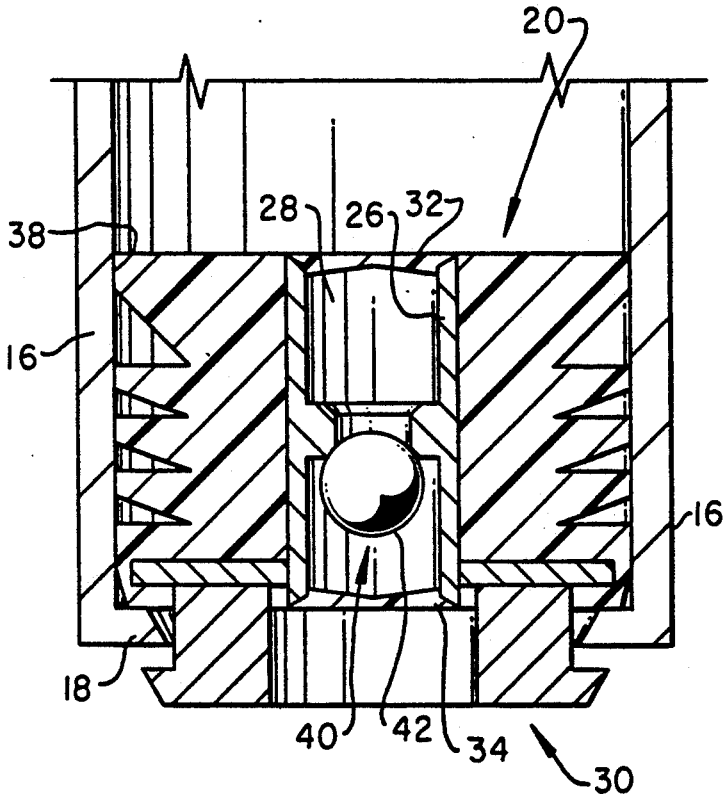
FIG. 2 is an enlarged section view of a bottom cementing plug of this invention.

As shown in more detail in FIG. 2, the bottom cementing plug 20 has a cylindrical body 26 having a passage 28 sealed off by a top diaphragm 32 and a bottom diaphragm 34. Encircling the lower end of passage 28 and adjacent to diaphragm 34 is a coupling device, shown in FIG. 2 as a latch 30.

The bottom plug 20 has a pliable exterior that is press-fit into the inside of the casing. Preferably, the exterior is made up of a plurality of wiper blades 38, formed of molded rubber. In the preferred construction, a one-way check valve 40 is integral to passage 28. Check valve 40 is oriented to prevent any material or fluid from entering the bottom of the passage 28 and working its way to the top of the bottom cementing plug 20. The check valve 40 may be a flapper-type or, as shown in FIG. 2, a check ball-type 42.

The conventional practice for cementing casing in a bore hole requires that drilling equipment create a bore hole and then removed so that a casing string can be lowered to the desired level in the bore hole. Typically, the casing string will have a guide shoe at the lower end with a float collar one to three links above. This float collar essentially gives the casing a closed end, because fluid or mud is prohibited from passing up into the casing string.

As this casing string is lowered, it can cause several problems. The first is the differential pressure on possibly weak formations, which can result in damage to the formation or planting of the casing string. Another problem is that the reciprocation or rotation of the close-ended casing string to move it down and through the bore hole can cause a swab-surge effect on the formation. Also, if the casing string is hung up on an obstruction in the bore hole, the casing string must be pulled up out of the bore hole and drilling equipment must be introduced into the bore hole to remove the obstruction.

Once the casing string is at its desired level, a conventional bottom plug is forced down the casing string by cement slurry. The bottom plug seats against the float collar wherein the cement slurry ruptures the diagram of the bottom plug, allowing the cement slurry to be pumped through the float collar, down the casing and in the annular space between the casing and bore hole. A top plug is used to force the cement slurry down the casing string and through the bottom plug.

In contrast to the conventional practice and in accordance with the present invention, the modified casing 16 is lowered into the bore hole 12 with generally an open end through lip 18. In this configuration, the casing 16 only causes minor differential pressure on the formation, as well as minimizes the swab-surge effect. Another advantage of running the casing string with an open end is that, if the casing is hung up by an obstruction in the bore hole, a drilling underreamer can be introduced into the casing to drill out the obstruction in the bore hole. By being able to introduce drilling equipment into the casing string, valuable rig time is saved. The time it takes to pull the casing string out of the bore hole, introduce the drilling equipment to remove the obstruction and to reintroduce the casing string into the bore hole is not necessary when this case cementing system is used.

Once the casing string 16 is at its desired depth, the bottom cementing plug 20 is press-fit into the inner wall of casing 16. The bottom plug 20 is then forced down through the casing 16 by the cement slurry 24, which in turn is pushed down by top plug 22. When the bottom plug 20 reaches the end of the casing string 16, the latch 30 slips over and is coupled to the lip 18 of the modified casing 16. This coupling prevents the bottom cementing plug 20 from being pushed through the bottom of the casing 16, as well as preventing any back pressure from pushing the bottom plug off the bottom and up through the casing 16.

The increased pressure of the cement slurry 24 ruptures the top diaphragm 32, pushes aside check ball 42 and ruptures bottom diaphragm 34 so that the cement slurry 24 is pumped out of the bottom of the casing 16 and up and around the annular space 44 between the bore hole 12 and the casing 16. The cement slurry 24 sets and holds the casing string 16 in a fixed position in the bore hole 12.

The bottom wiper plug 20 also provides an effective mechanical wiping action and cleaning of the inner wall of the casing string 16 so that the cement slurry 24 is not contaminated by any fluids or mud solids inside the casing string. This cementing operation is completed once the top plug 24 is juxtaposed to the bottom cementing plug 20.

The method and system of the present invention, herein described, provides a simplified, economical and efficient way of cementing casing in a bore hole.

It is to be understood that the technology, as employed in the description and claims incorporated herein, is used by way of description and not by way of limitation, to facilitate understanding of the structure, function and operation of the combination of elements which constitute the present invention. Moreover, while the foregoing description and drawings illustrate in detail the working embodiments of the invention, to those skilled in the art to which the present invention relates, the present disclosure will suggest many modifications in construction, as well as widely differing embodiments and applications, without thereby departing from the spirit and scope of the invention. The present invention, therefore, is intended to be limited only by the scope of the appended claims and the applicable prior art.

What is claimed is:

1. A system for cementing a casing in a bore hole, said system comprising:

a. a casing string having an inwardly extending lip on its lower end;

b. a bottom plug, having a cylindrical body with a through passage covered on the bottom covered by a diaphragm, with a latch engageable with said lip of said casing string;

c. a top plug; and d. a cement slurry interposed between said bottom and said top plugs, wherein said latch engages with said lip of said casing string and said cement slurry ruptures said diaphragm to pass through said bottom plug and out the bottom of said casing string and around the end of the casing.

2. The system as set forth in claim 1 further comprises a second diaphragm covering the top of said through passage.

3. A method for cementing well casing in a well bore, comprising the steps of:

a. providing a system for cementing well casing in a well bore, said system including casing with the lower end having an inwardly-extending lip, a bottom plug having a cylindrical body with a through passage covered by a top and bottom diaphragm and a latch engagable with said lip;

b. pumping said bottom plug into casing to remove mud from the inside wall of said casing;

c. pumping cement slurry down behind said bottom cementing plug;

d. pushing a top plug against the cement slurry;

e. engaging said latch of said bottom cementing plug with said lip of said casing; and f. forcing said cement slurry through said diaphragms of said bottom plug through the bottom of said casing and into the annular space between said casing and the bore hole.

4. A bottom plug for cementing a casing in a bore hole, said bottom plug comprising:

a. a cylindrical body having a through passage;

b. a diaphragm covering the bottom of said passage of said body; and c. a latch on the bottom of said body.

5. The bottom plug set forth in claim 4 further comprises a check valve in said passage, allowing fluid to pass from the top of said bottom plug down through said passage but preventing the fluid from moving from the lower portion of said bottom plug up and into the top portion of said bottom plug.

6. The plug set forth in claim 5, wherein said cylindrical body has a plurality of wiper blades on the perimeter to mechanically wipe the inner wall of the casing.

7. The bottom plug as set forth in claim 4 further comprises a second diaphragm covering the top of said passage of said body.

* * * * *